US008890766B2

(12) United States Patent
Huynh

(10) Patent No.: US 8,890,766 B2
(45) Date of Patent: Nov. 18, 2014

(54) LOW PROFILE MULTI-BAND ANTENNAS AND RELATED WIRELESS COMMUNICATIONS DEVICES

(75) Inventor: Minh-Chau Huynh, Redwood City, CA (US)

(73) Assignees: Sony Corporation, Lund (SE); Sony Mobile Communications AB, Lund (SE)

( * ) Notice: Subject to any disclaimer, the term of this patent is extended or adjusted under 35 U.S.C. 154(b) by 334 days.

(21) Appl. No.: 13/361,267

(22) Filed: Jan. 30, 2012

(65) Prior Publication Data

US 2013/0141303 A1 Jun. 6, 2013

Related U.S. Application Data

(60) Provisional application No. 61/565,728, filed on Dec. 1, 2011.

(51) Int. Cl.

| | |
|---|---|
| ***H01Q 1/12*** | (2006.01) |
| ***H01Q 25/00*** | (2006.01) |
| ***H01Q 9/04*** | (2006.01) |
| ***H01Q 5/02*** | (2006.01) |
| *H01Q 23/00* | (2006.01) |

(52) U.S. Cl.

USPC ..... 343/878; 343/879; 343/845; 343/844; 343/700 MS

(58) Field of Classification Search

CPC ... H01Q 1/243; H01Q 5/0062; H01Q 9/0457; H01Q 5/0037; H01Q 13/10

USPC ..... 343/878, 792

See application file for complete search history.

(56) References Cited

U.S. PATENT DOCUMENTS

| | | | | |
|---|---|---|---|---|
| 5,943,020 | A | 8/1999 | Liebendoerfer et al. | |
| 2001/0015701 | A1 * | 8/2001 | Ito et al. | 343/700 MS |
| 2004/0027286 | A1 * | 2/2004 | Poilasne et al. | 343/700 MS |
| 2008/0316115 | A1 | 12/2008 | Hill et al. | |

FOREIGN PATENT DOCUMENTS

| | | | |
|---|---|---|---|
| EP | 0 795 926 | A2 | 9/1997 |
| EP | 0 871 238 | A2 | 10/1998 |

(Continued)

OTHER PUBLICATIONS

Wood, C., "Improved bandwidth of microstrip antennas using parasitic elements," IEE Proc., vol. 127, Pt. H., No. 4, Aug. 1980, pp. 231-234.

(Continued)

*Primary Examiner* — Dameon E Levi
*Assistant Examiner* — Ricardo Magallanes
(74) *Attorney, Agent, or Firm* — Myers Bigel Sibley & Sajovec

(57) ABSTRACT

Low-profile antenna systems are provided including a ground plane; an upper antenna element parallel to and spaced apart from the ground plane; at least one vertical plate configured to vertically connect the upper antenna element and the ground plane; first and second metallic wings each connected at one end to respective sides of the at least one vertical plate and spaced apart from both the ground plane and the upper antenna element; an electrically floating plate on a same plane as the upper antenna element and spaced apart from the upper antenna element to provide a gap therebetween; and a metallic feed plate parallel to and between the upper antenna element and the ground plane and extending beneath the gap between the electrically floating plate and the upper antenna element. Related wireless communications devices are also provided.

20 Claims, 13 Drawing Sheets

(56) References Cited

FOREIGN PATENT DOCUMENTS

| | | | |
|---|---|---|---|
| EP | 1 359 639 | A1 | 11/2003 |
| GB | 2 359 929 | A | 9/2001 |

OTHER PUBLICATIONS

Extended European Search Report, EP 12187953.0, Jan. 7, 2013, 13 pages.

* cited by examiner

LOW PROFILE MULTI-BAND ANTENNAS AND RELATED WIRELESS COMMUNICATIONS DEVICES

CLAIM OF PRIORITY

This application claims priority to U.S. Provisional Application No. 61/565,728, filed Dec. 1, 2011, the content of which is hereby incorporated herein by reference as if set forth its entirety.

FIELD

The present application relates generally to communication devices, and more particularly to, antennas and wireless communication devices using antennas.

BACKGROUND

Wireless communication devices, such as mobile telephones and personal digital assistants (PDAs), have become commonplace in today's society. In particular, the demand for smaller/thinner wireless communication devices has increased. However, as the demand for small devices has increased so has the demand for a variety of services to be performed by these devices. Thus, the size of a wireless communications device can only be made so small and still provide all the desired services. The size of these devices is often determined by the size of the display, battery, and antenna volume needed to satisfy antenna radiated performance requirements imposed by carriers.

Referring to FIGS. 1A and 1B, if the size of the antenna(s) in the wireless communication device 150 is not taken into consideration, the size of the wireless communication device 150 can be made relatively equivalent to the size occupied by the display, for example, liquid crystal display (LCD) 108, the metallic frame 185 used to keep the wireless communications device 150 mechanically rigid and robust, and the battery 180 as illustrated. As further illustrated, the printed circuit board (PCB) 170 fits within the total thickness ($H_{Total}$) of the wireless communications device 150, which is defined by the thickness ($H_a$) of the battery 180 and the thickness ($H_{LCD}$) of the LCD display 108. The length (L) and the width (W) of the LCD display 108 can be scaled accordingly.

However, when antenna performance matters, which is typically does, the overall size of the device often increases. Increased antenna performance is typically necessary to satisfy the increase in demand for services provided by the wireless communication device 150. Most conventional antenna designs typically require more volume, for example, more distance between the ground plane, such as the PCB 170 and the LCD frame of the device 150.

SUMMARY

Some embodiments of the present inventive concept provide a low-profile antenna system. The system includes a ground plane; an upper antenna element parallel to and spaced apart from the ground plane, wherein a spacing between the ground plane and the upper antenna element is less than about 6.0 mm; at least one vertical plate configured to vertically connect the upper antenna element and the ground plane; first and second metallic wings each connected at one end to respective sides of the at least one vertical plate and spaced apart from both the ground plane and the upper antenna element; an electrically floating plate on a same plane as the upper antenna element and spaced apart from the upper antenna element to provide a gap therebetween; and a metallic feed plate parallel to and between the upper antenna element and the ground plane and extending beneath the gap between the electrically floating plate and the upper antenna element.

In further embodiments of the present inventive concept a network of lumped components may be provided, wherein the lumped components are used to control a low-band frequency range such that the antenna system can be controlled and tuned down to about 700 MHz to cover the long term evolution (LTE) bands.

In still further embodiments, the ground plane may have a width of about 60 mm and a length from about 110 mm to about 130 mm.

In some embodiments, the system may further include a metallic frame configured to protect a display of a wireless communications device, wherein the metallic frame is the ground plane.

In further embodiments, the system may further include a back cover of a wireless communications device, wherein the upper antenna element is positioned on an outer surface of the back cover of the wireless communications device.

In still further embodiments, the upper antenna element may have a width of about 60 mm and a length from about 10 mm to about 25 mm.

In some embodiments, the upper antenna element may control the high frequency band and wherein the high frequency band is from about 1700 MHz to beyond 2700 MHz.

In further embodiments, the system may further include an antenna feed directly connected to the metallic feed plate.

In still further embodiments, the metallic feed plate may have one of an "L" shape and a rectangular shape. Furthermore, the gap between the upper antenna element and the electrically floating plate may be from about 0.5 mm to about 3.00 mm.

In some embodiments, the metallic wings may have a length that is less than a length of the upper antenna element.

In further embodiments, the electrically floating plate may have a width of about 60 mm and a length of about 45 mm.

In still further embodiments, the electrically floating plate may be used to tune the high frequency band and wherein the high frequency band is from about 1700 MHz to beyond 2700 MHz.

In some embodiments, the antenna system may have wideband and multi-band resonance characteristics.

In further embodiments, a low-frequency band range may be from 800 MHz to about 1100 MHz and a high-frequency range may be from about 1700 MHz to beyond 2700 MHz.

Still further embodiments provide a low-profile antenna system for use in a wireless communications device, the antenna system having an antenna height that is less 6.00 mm, wherein a total thickness of the wireless communications device including the antenna system is about 8 mm.

Some embodiments provide a wireless communications device including a housing; and an antenna system coupled to the housing. The antenna system includes a ground plane; an upper antenna element parallel to and spaced apart from the ground plane, wherein a spacing between the ground plane and the upper antenna element is less than about 6.0 mm; at least one vertical plate configured to vertically connect the upper antenna element and the ground plane; first and second metallic wings each connected at one end to respective sides of the at least one vertical plate and spaced apart from both the ground plane and the upper antenna element; an electrically floating plate on a same plane as the upper antenna element and spaced apart from the upper antenna element to provide a gap therebetween; and a metallic feed plate parallel to and between the upper antenna element and the ground plane and extending beneath the gap between the electrically floating plate and the upper antenna element.

Other antennas, communications devices, and/or methods according to embodiments of the inventive concept will be or become apparent to one with skill in the art upon review of the following drawings and detailed description. It is intended that all such additional antennas, communications devices, and/or methods be included within this description, be within the scope of the present inventive concept, and be protected by the accompanying claims. Moreover, it is intended that all embodiments disclosed herein can be implemented separately or combined in any way and/or combination.

BRIEF DESCRIPTION OF THE DRAWINGS

The accompanying drawings, which are included to provide a further understanding of the inventive concept and are incorporated in and constitute a part of this application, illustrate certain embodiment(s) of the inventive concept. In the drawings.

DETAILED DESCRIPTION OF EMBODIMENTS

Figures 1A, 1B:
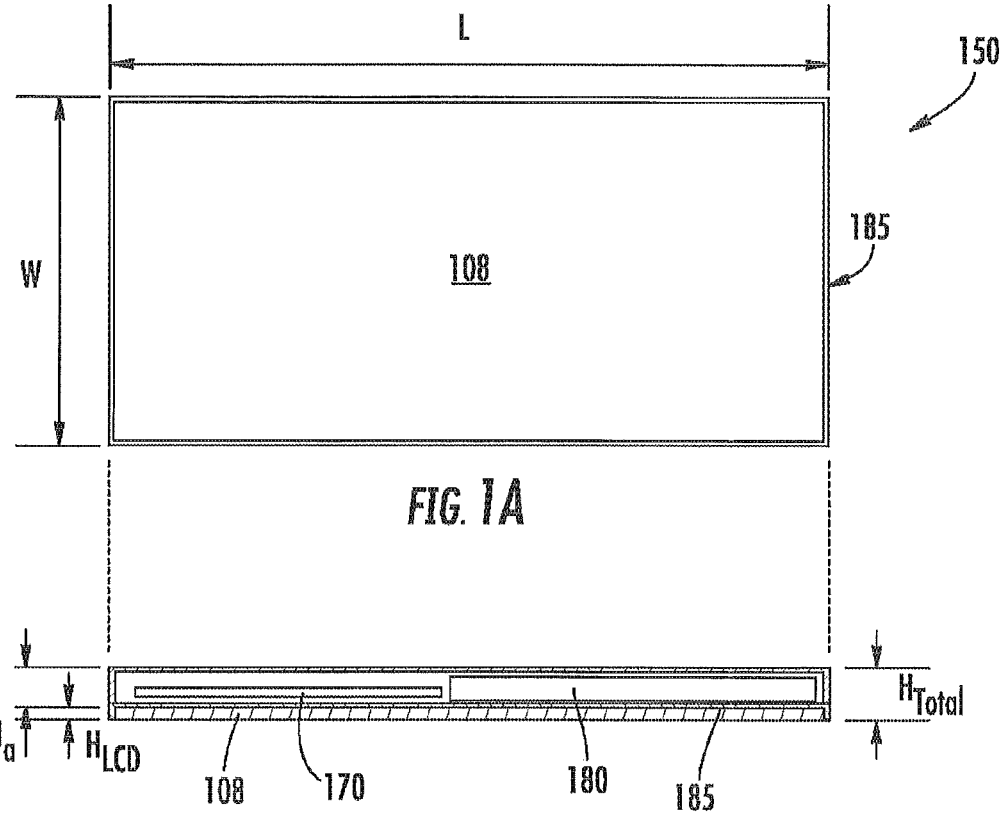
FIG. 1A is a diagram illustrating a top view of a liquid crystal display (LCD) of a wireless communications device according to some embodiments of the present inventive concept.
FIG. 1B is a cross-section of a liquid crystal display (LCD) of a wireless communications device according to some embodiments of the present inventive concept.

The inventive concept will now be described more fully hereinafter with reference to the accompanying drawings, in which embodiments of the inventive concept are shown. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the inventive concept are described herein with reference to schematic illustrations of idealized embodiments of the inventive concept. As such, variations from the shapes and relative sizes of the illustrations as a result, for example, of manufacturing techniques and/or tolerances, are to be expected. Thus, embodiments of the inventive concept should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the inventive concept.

For purposes of illustration and explanation only, various embodiments of the present inventive concept are described herein in the context of a wireless communication terminal ("wireless terminal" or "terminal") that includes a an antenna system, for example, a MIMO antenna, that is configured to transmit and receive RF signals in two or more frequency bands. The antenna may be configured, for example, to transmit/receive RF communication signals in the frequency ranges used for cellular communications (e.g., cellular voice and/or data communications), WLAN communications, and/or TransferJet communications, etc.

As discussed above, when antenna performance matters, which is typically does, the overall size of the wireless communications device often increases. Increased antenna performance is typically necessary to satisfy the increase in demand for services provided by the wireless communication device 150.

Figure 2A:
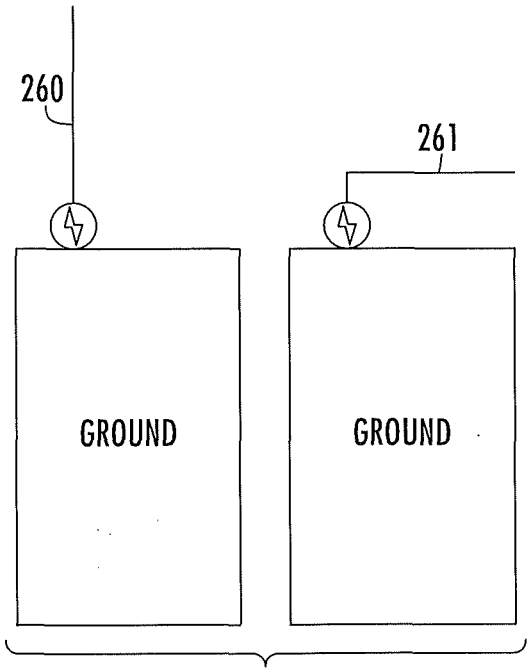
FIG. 2A illustrates antenna elements with no direct contact to ground.
Figure 2B:
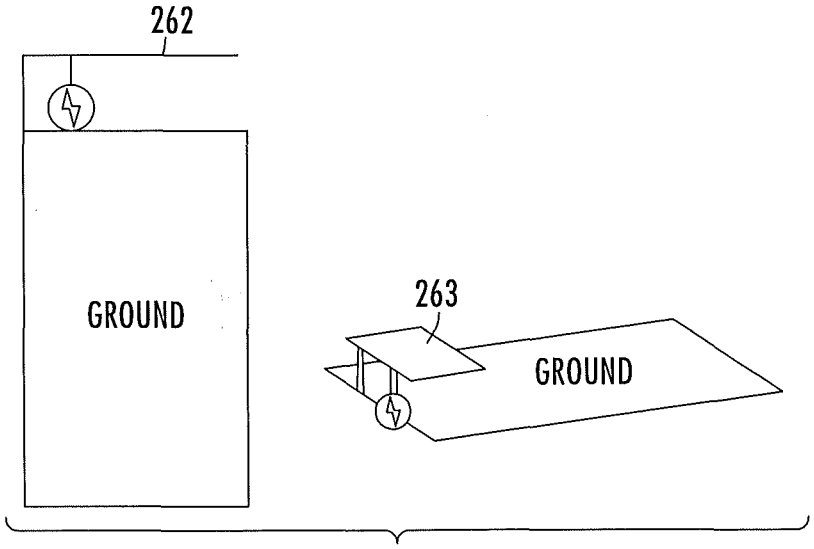
FIG. 2B illustrates antenna elements with direct contacts to ground.

There are several types of antennas commonly used in wireless communication devices. These types can be generally classified in two categories: ungrounded and grounded designs. As illustrated in FIG. 2A, in an ungrounded design, the main antenna element 260 (monopole antenna) and 261 (bent monopole antenna) have no direct point of contact between the main antenna element and the ground. In contrast, as illustrated in FIG. 2B, in a grounded design, the main antenna element 262 (Inverted-F Antenna (IFA)) and 263 (Planar Inverted-F Antenna (PIFA)) is directly connected to ground. Performance of these antenna types is a function of antenna volume and proximity of the antenna elements to ground.

Ungrounded designs, like those illustrated in FIG. 2A, typically require the antenna element (260, 261) to be located in a ground-free antenna volume in order to supply adequate antenna performance. In other words, any overlapping ground will greatly impact antenna performance due to the inherent antenna characteristics of this type. Thus, these antenna types generally require an increase in the device's length and placement of the antenna element in a volume confined at the end of the device without any overlapping ground.

Grounded antenna designs, like those illustrated in FIG. 2B, are antenna types where main antenna elements can be built over ground planes. With enough distance (separation, antenna height) between the antenna element (262, 263) and the ground plane, this antenna type can achieve adequate performance. When this distance becomes too small, antenna performance deteriorates. For example, the antenna may exhibit narrow antenna impedance bandwidth and/or reduced antenna efficiency. For adequate antenna performance in a typical wireless communications device, an antenna height of at least about 7.0 mm is generally required for the 700-800 MHz bands. Thus, the designs illustrated in FIGS. 2A and 2B exhibit limitations that inherently make the wireless mobile device larger, i.e. longer or thicker, which as discussed above, is not desirable.

Thus, antenna systems in accordance with some embodiments of the present inventive concept may provide an antenna design that has radiated properties that make the antenna relatively low profile while still maintaining adequate radiated performance. As will be discussed below with respect to FIGS. 3 through 12, antenna systems in accordance with embodiments discussed herein, can be built over a ground plane, but have a smaller antenna height than conventional grounded antenna types illustrated in FIG. 2B.

Figure 3A:
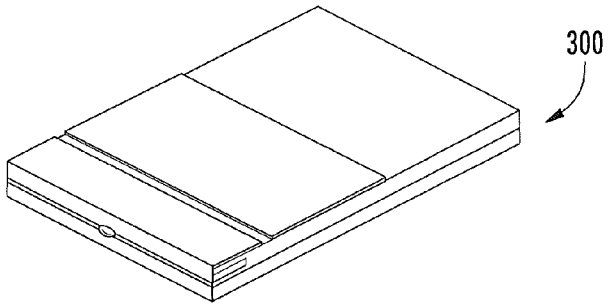
FIG. 3A is diagram of an antenna in accordance with some embodiments of the present inventive concept.
Figure 3B:
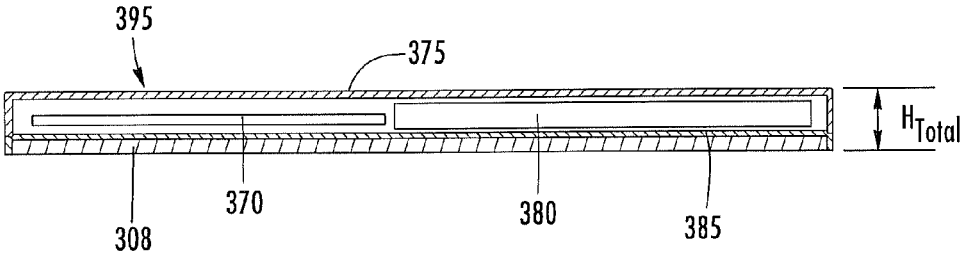
FIG. 3B is a cross-section of the antenna illustrated in FIG. 3A in accordance with some embodiments of the present inventive concept.

In particular, as illustrated in FIGS. 3A and 3B, antenna systems 300 in accordance with some embodiments discussed herein may only occupy the space defined by the LCD display 308 and metallic frame 385, and the battery 380 as illustrated in the diagram and a cross section of antenna systems illustrated in FIGS. 3A and 3B, respectively. As further illustrated, the antenna area 395 on the back cover 375 of the wireless communications device 350 is provided with the total thickness ($H_{Total}$) of the device. The PCB 370 also fits within the total thickness ($H_{Total}$) of the wireless communications device.

Referring now to FIGS. 4A through 4D, details with respect to antenna systems in accordance with some embodiments of the present inventive concept will be discussed. As illustrated in FIGS. 4A-4D, antenna systems in accordance with some embodiments of the present inventive concept include a ground plane 405, a metallic element 401, a back cover 475, a vertical plate 409, an antenna feed 418, a metallic feed plate 407, two metallic wings 403, an electrically floating plate 404 and an optional network of lumped components 406.

The ground plane 405 may have a size similar to the size of an LCD display of a typical "Smartphone." For example, the ground plane may have a length from about 110 mm to about 130 mm and a width from about 50 mm to about 70 mm. In some embodiments, the a metallic frame that serves to protect the LCD display and strengthen the structure of the mobile device may also serve as the ground plane 405 without departing from the scope of the present inventive concept.

Figure 4C:
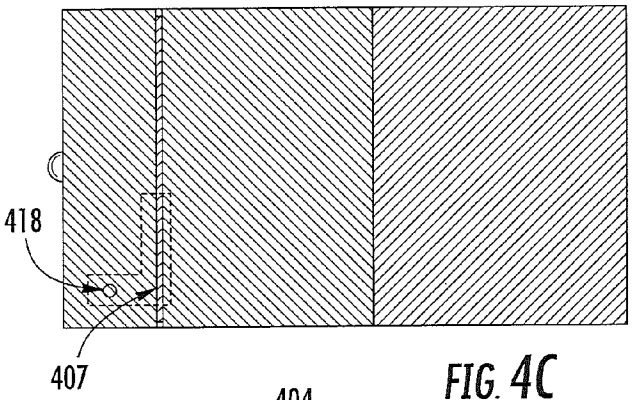
FIGS. 4A through 4D are diagrams illustrating antennas according to some embodiments of the present inventive concept.
Figure 4D:
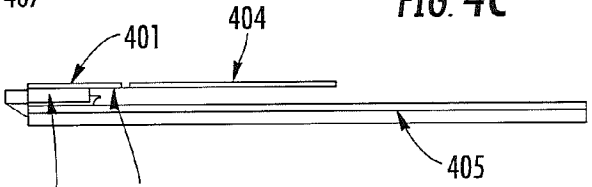
Figure 4A:
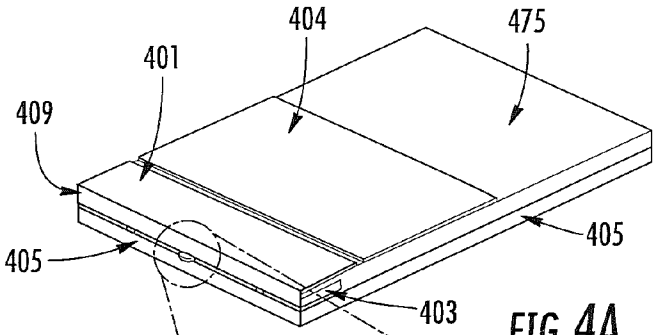
Figure 4B:
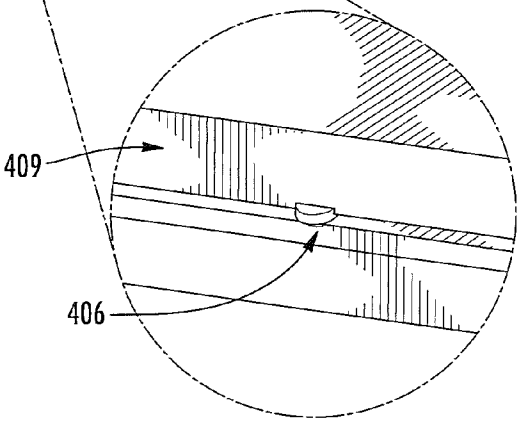

As illustrated in FIGS. 4A and 4D, the metallic element 401 is placed in parallel to the ground plane 405. In some embodiments, the upper antenna element 401 may be placed on an outer surface of the back cover 475 of the wireless communications device. A distance between the ground plane 405 and the upper antenna element 401 should be smaller than that of a conventional grounded-type antenna design (FIG. 2B), which is typically greater than or equal to about 6.0 mm in order to have good efficiency performance in the 700-900 MHz range. The metallic element 401 may have a length from about 10 mm to about 25 mm, a width of about 60 mm (similar to width of the ground plane). The metallic element 401 is relatively thin in general in antenna design in small wireless communications devices, for example, less than about 0.1 mm. The upper antenna element 401 may be used to control the high frequency band, which is from about from about 1700 MHz to beyond 2700 MHz.

As illustrated in FIG. 4, a longer edge of the upper antenna element 401 and a narrower edge of the ground plane 405 are connected by one or more vertical plates 409. In some embodiments, the vertical plates 409 are a series of a vertical plates 409 followed by an optional discrete passive component or a network of lumped components 406 used for antenna impedance matching purposes. The components 406 may be a capacitive/inductive network of elements or a direct contact between the vertical plate 409 and the ground plane, which controls the low frequency band resonance. If this component 406 is not included in the antenna system, leaving the vertical plate 409 electrically disconnected to the ground plane 405, the antenna system may not have access to the low frequency band, for example, from about 700-750 MHz bands that are used in the United States (LTE Band 13 and Band 17) in accordance with some embodiments.

As further illustrated, an antenna feed 418 is directly connected to the metallic feed plate 407. The metallic feed plate 407 is illustrated in FIG. 4C as being L-shaped, however, embodiments of the present inventive concept are not limited to this configuration. For example, the metallic feed plate 407 could be rectangular or any other shape as long as the metallic shape extends beneath the gap between the upper antenna element 401 and the electrically floating plate 404. The gap between the upper antenna element 401 and the electrically floating plate 404 may be from about 0.5 mm and about 3.00 mm The metallic feed plate 407 is a feed plate and is placed in parallel with and between both the ground plane 405 and upper antenna element 401.

As further illustrated, two metallic "wings" 403 are connected on each side of the vertical plate 409. Only one "wing" is visible in FIGS. 4A and 4D, however, a similar "wing" is provided on the opposite side of the device. The metallic wings 403 are provided running along the side of the upper antenna element 401 and ground plane 405. As illustrated in FIGS. 4A and 4D, there is no direct electrical contact between the wings 403 and the ground plane 405 or the upper antenna element 401. The metallic wings 403 are shorter than the upper antenna element 401 as illustrated in the Figures and electrically in contact with the vertical plate 409 on the edges as shown.

As further illustrate in FIGS. 4A and 4D, an electrically floating plate 404 is provided on the same plane as the upper antenna element 401 and at a close distance to the upper antenna element 401. For example, the distance between the upper antenna element 401 and the floating plate 404 may be from about 0.5 mm to about 3.0 mm. The floating plate 404 may have a width of about 60 mm (similar to the width of the ground plane) and a length of about 45 mm. The floating plate 404 may be used to tune the high frequency band, from about 1700 MHz to beyond 2700 MHz.

Various performance results of antenna systems in accordance with some embodiments of the present inventive concept will be discussed. The performance results are for antenna systems having a width of 60 mm, a length of 112 mm, a total thickness $H_{total}$ of 8 mm and an antenna thickness of 4.5 mm.

Antenna systems in accordance with various embodiments discussed herein have wideband and multi-band resonance characteristics. The low-frequency band range spans from 800 MHz to 1100 MHz and the high-frequency range spans from 1700 MHz to beyond 2700 MHz for a Voltage Standing Wave Ratio (VSWR) of 3 or less. VSWR is a parameter that defines how well the impedance of the antenna is matched to 50 Ohms at a certain frequency. A perfectly matched antenna impedance to 50 Ohm has a VSWR of 1. The VSWR parameter also relates to mismatch loss. A VSWR of 1 has no mismatch loss. A VSWR of 3 has a mismatch loss of about 1.25 dB. This mismatch loss may contribute to the degradation of the total antenna efficiency. For antennas designed for wireless communications devices, a VSWR of 3 or less is often tolerated.

The matching network of lumped elements (406) discussed above with respect to FIG. 4, can be used to control the low-band frequency range to cover more band coverage (not shown here).

Figure 5:
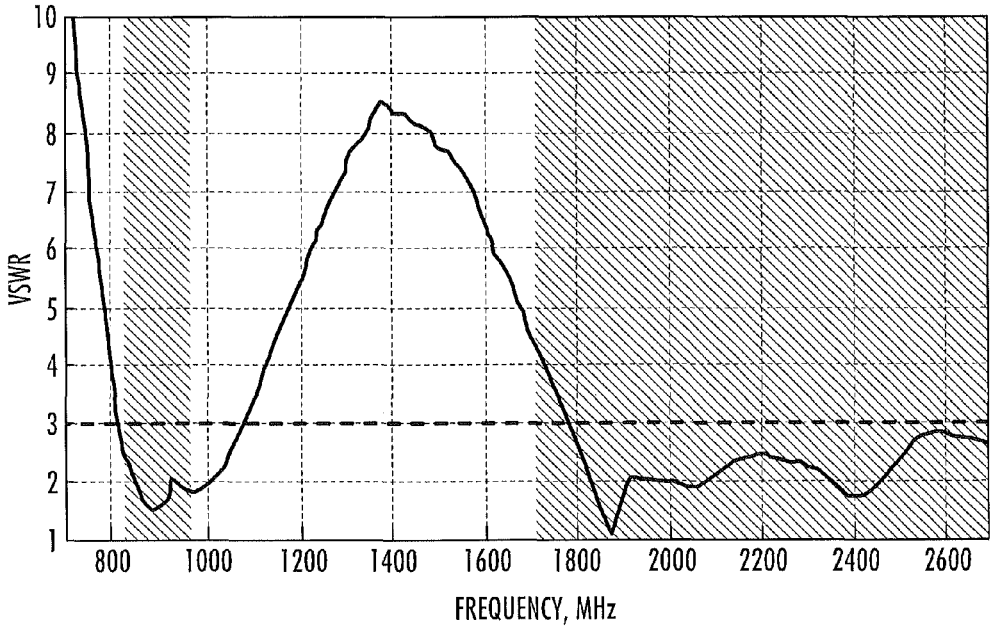
FIG. 5 is graph illustrating the voltage standing wave radio (VSWR) of antennas according to some embodiments of the present inventive concept.

FIG. 5 is a graph illustrating VSWR vs. Frequency in MHz for antenna systems in accordance with some embodiments of the present inventive concept. In particular, FIG. 5 illustrates an example of impedance response when the vertical plate (409) is connected to the ground plane (405) at a centerline of the device via an inductor of about 1.0 nH. As illustrated in the graph, by increasing the inductor value, the low-band frequency range shifts down from the 800-900 MHz band (as illustrated in the Figure) without affecting the response in the high band frequency range and for a specific value of inductor, the low-band frequency range can cover the 700-750 MHz bands that are used in the United States (LTE Band 13 and Band 17) in accordance with some embodiments.

Figure 6:
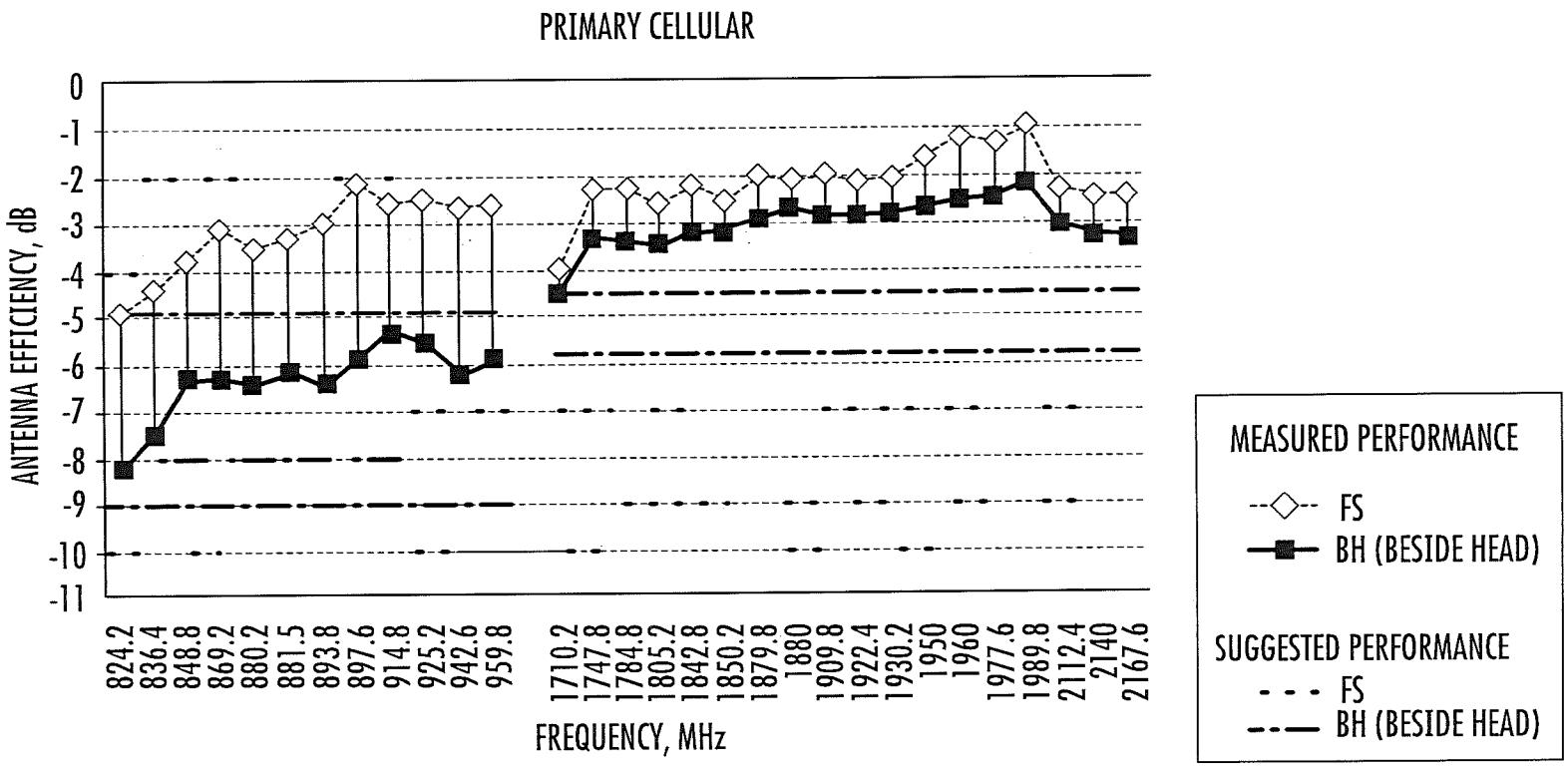
FIG. 6 is a graph illustrating the efficiency of antennas according to some embodiments of the present inventive concept in Free-Space (FS) and beside the head (BH).

Referring now to FIG. 6, a graph illustrating antenna efficiency (dB) vs. frequency (MHz) for antenna systems in accordance with some embodiments will be discussed. FIG. 6 illustrates the total efficiency of the proposed antenna for both the free-space (FS) and to the talk position or beside the head (BH) environments. The antenna system is assumed to be located at the bottom of the wireless communications device. The performance of the antenna system is compared to a suggested level often used for wireless communications device as a satisfactory performance level to meet radiated performance requirements imposed by wireless carriers. The suggested levels are illustrated as straight lines labeled FS or BH. As illustrated in FIG. 6, the proposed antenna system in each environment performs better than the suggested performance level.

Conventional grounded type antenna designs with similar dimensions to the antenna system in accordance with embodiments discussed above would not perform as good as the results shown in FIGS. 5 and 6. In a conventional antenna having 4.5-mm $H_a$, bandwidth and efficiency of conventional grounded designs will likely degrade. Embodiments of the present inventive concept provide an alternative with better performance.

Figure 7A:
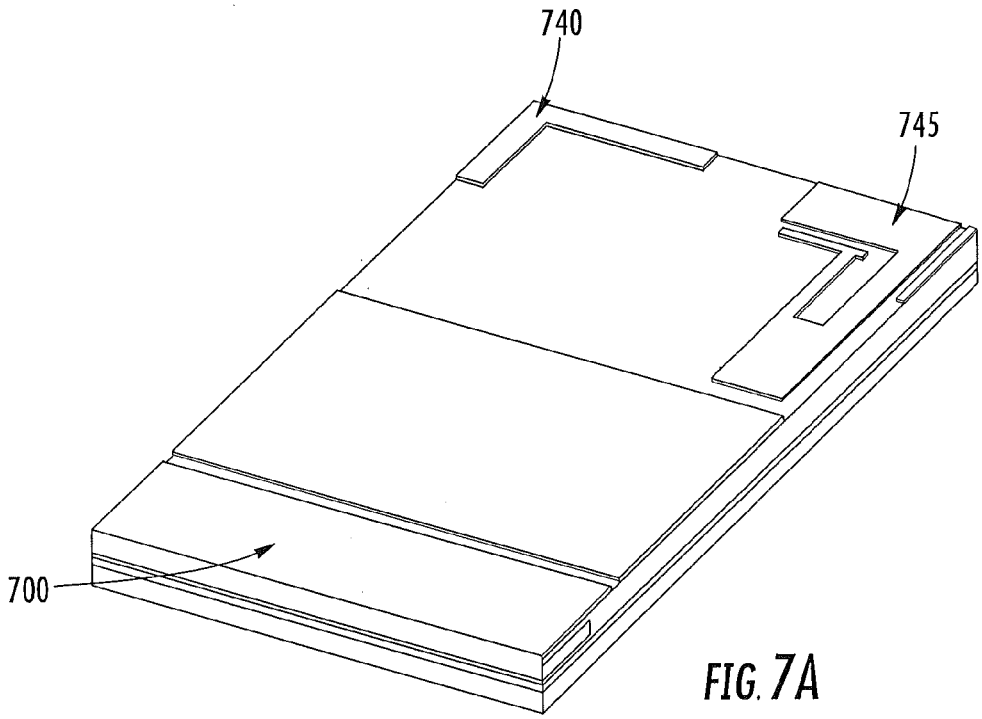
FIGS. 7A and 7B are diagrams illustrating a multiple antenna system according to some embodiments of the present inventive concept.
Figure 7B:
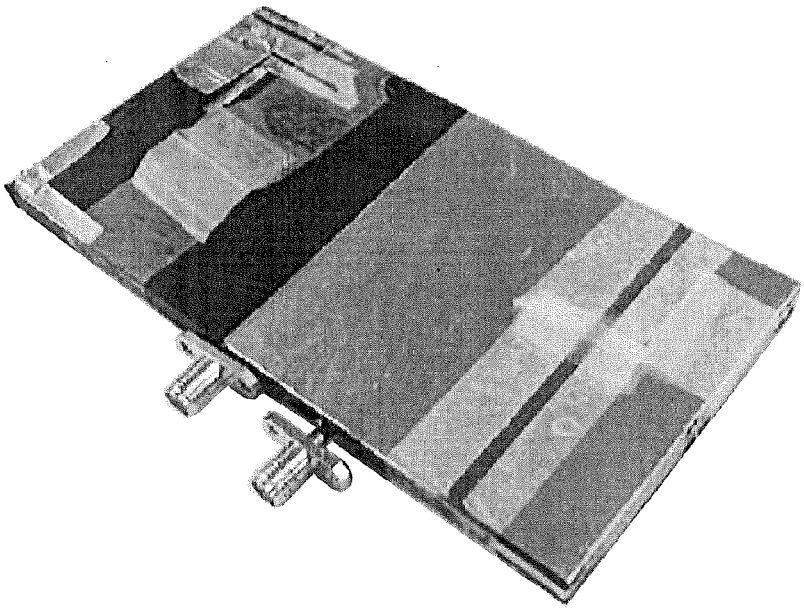

Referring now to FIGS. 7A and 7B, performance of antenna systems in accordance with some embodiments will be discussed. As illustrated in FIG. 7, the antenna system 700 in accordance with embodiments discussed herein can be used as the primary cellular antenna in an antenna system of a Smartphone that is capable of doing MIMO/Receive Diversity, WiFi, Bluetooth, GPS wireless communication. As illustrated in FIG. 7A, in addition to the antenna system 700, the system has an additional GPS antenna 740, a receive diversity (RxD) antenna, and a WiFi/BT antenna 745. In the antenna system illustrated in FIG. 7A, the RxD and WiFi/BT 745 is combined into one single feed antenna. However, it will be understood that embodiments are not limited to this configuration.

An important parameter in an antenna system is the coupling parameter between antenna pairs. If coupling between two antennas at a frequency of interest is too strong, then antenna efficiency of both antennas may be degraded at that frequency. In most cases, the primary cellular antenna has a low coupling value with non-cellular antennas, i.e., WiFi/BT and GPS antennas. Coupling may potentially be stronger between the primary and RxD antenna as they both work at the same frequency at the same time. In wireless communications devices, a coupling value of −10 dB or below can be tolerated.

Figure 8:
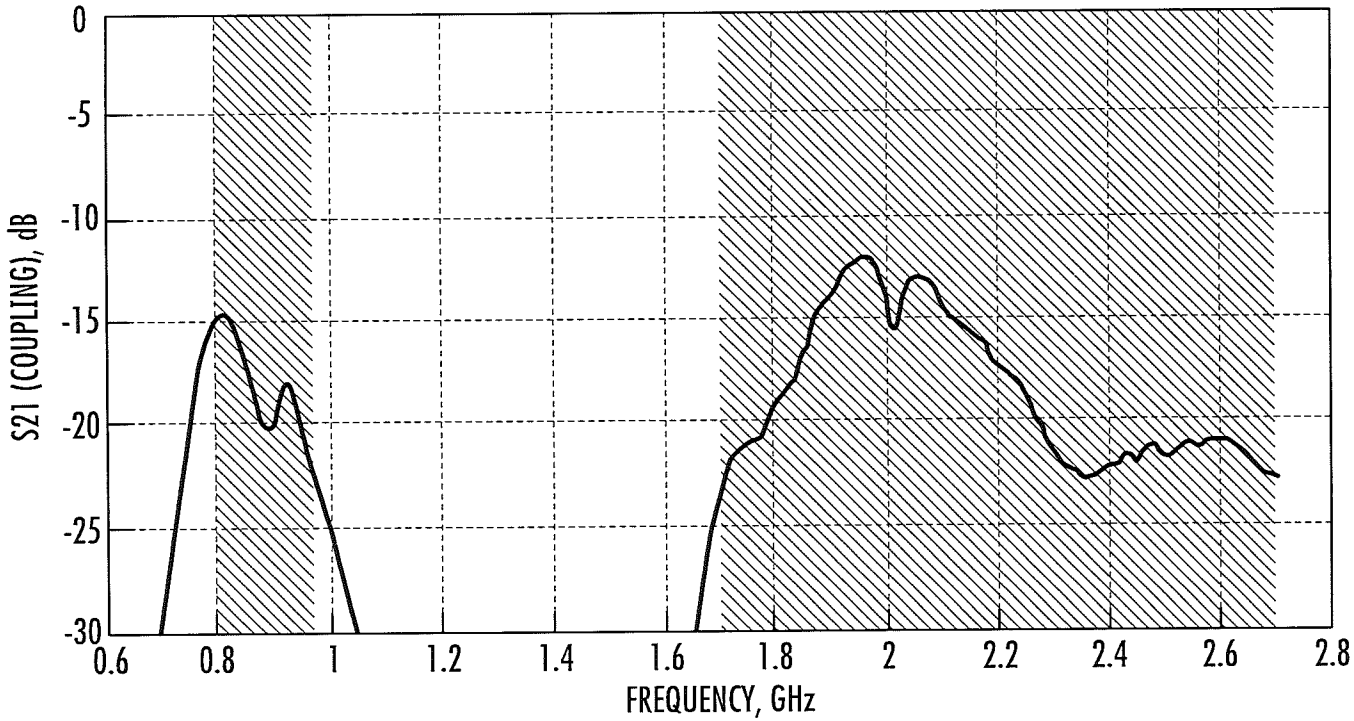
FIG. 8 is a graph illustrating coupling performance between the primary antenna and the receive diversity antennas according to some embodiments of the present inventive concept.

FIG. 8 illustrates coupling as function of frequency between the antenna system 700 as the primary and the RxD antenna 745. Good performance of the RxD antenna 745 in FIGS. 9A and 9B shows the validity of coupling effect in FIG. 8 as the coupling effect of two antennas can be reduced by degrading antenna efficiency of one or both antennas.

Figure 9A:
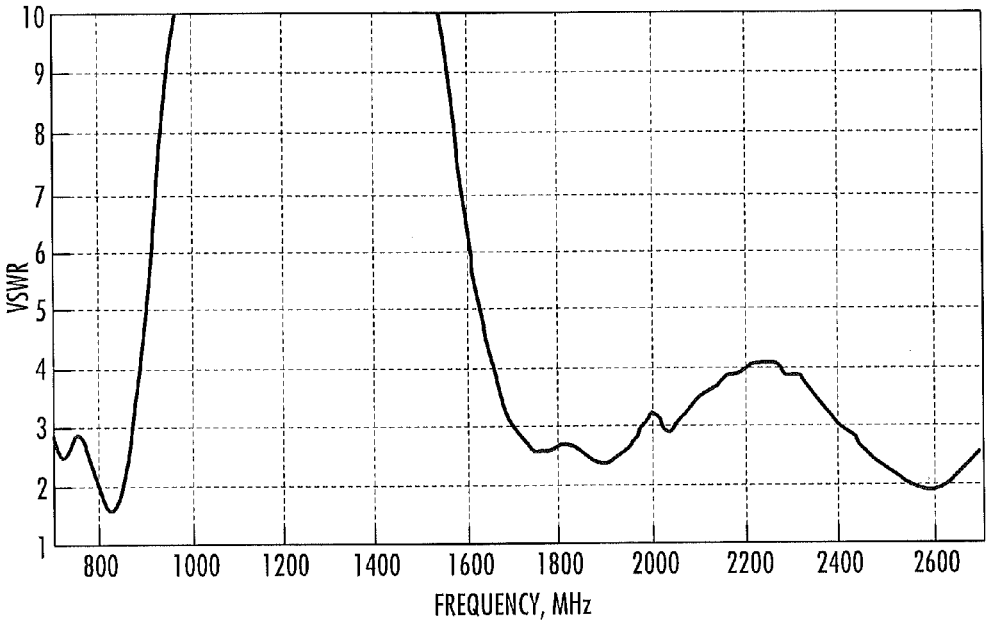
FIGS. 9A and 9B are graphs illustrating measured performance of the receive diversity antenna (A) VSWR and (B) antenna efficiency in free space (FS) and beside the head (BH) according to some embodiments of the present inventive concept.
Figure 9B:
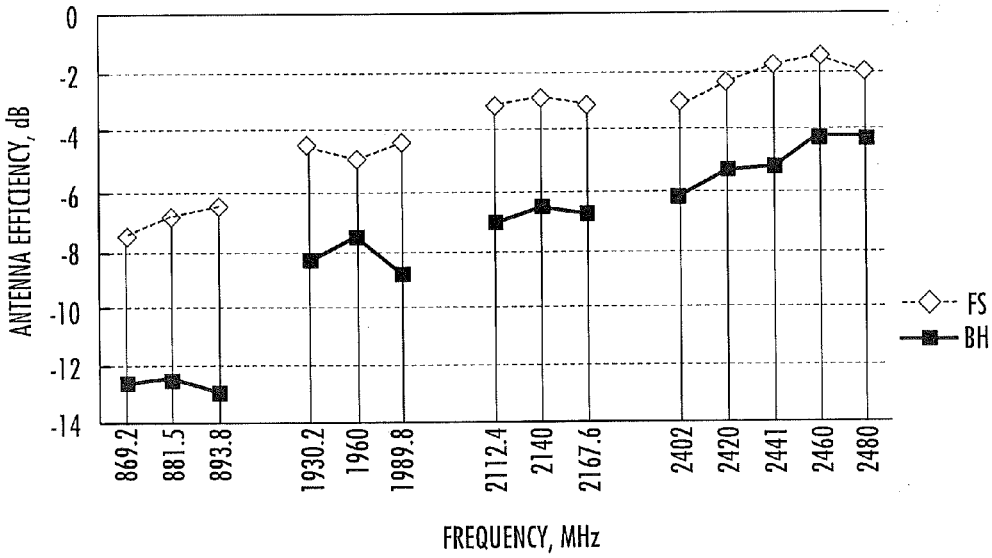

FIGS. 9A and 9B are graphs illustrating the measured performance of the receive diversity/WiFi/BT antenna 745, optimized for the U.S. bands for the receive diversity for VSWR (FIG. 9A) and antenna efficiency (FIG. 9B) in free space (FS) and the talk position or beside the head (BH).

Performance of antenna systems in accordance with some embodiments in a wireless communications device in handheld environment will be discussed. Performance in Freespace (FS) and beside the head (BH) is typically a key parameter sought by wireless carriers to gauge how good a device is, as discussed above with respect to FIG. 6. In reality, wireless communications devices, such as smartphones, are held by a user hand. It is generally a good idea to show how well the antenna performs in a wireless device when held in a hand (FIG. 10A) and when a user holds the device against the head (FIG. 10B).

Figure 10A:
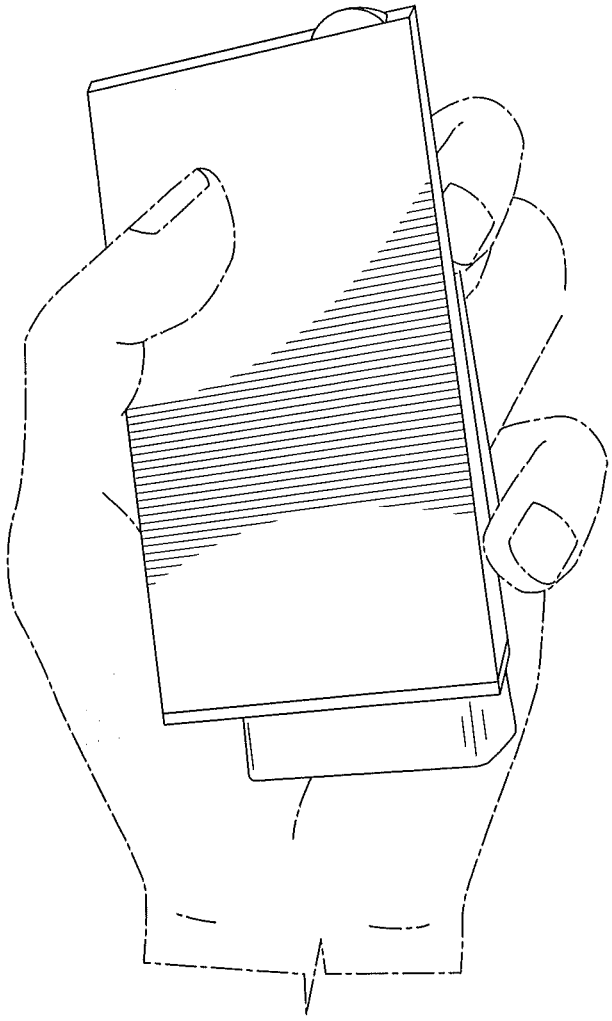
FIGS. 10A through 10B are photos of a wireless communications device including an antenna in accordance with some embodiments of the present inventive concept held in the hand (A) and held in the hand near the head (B).
Figure 10B:
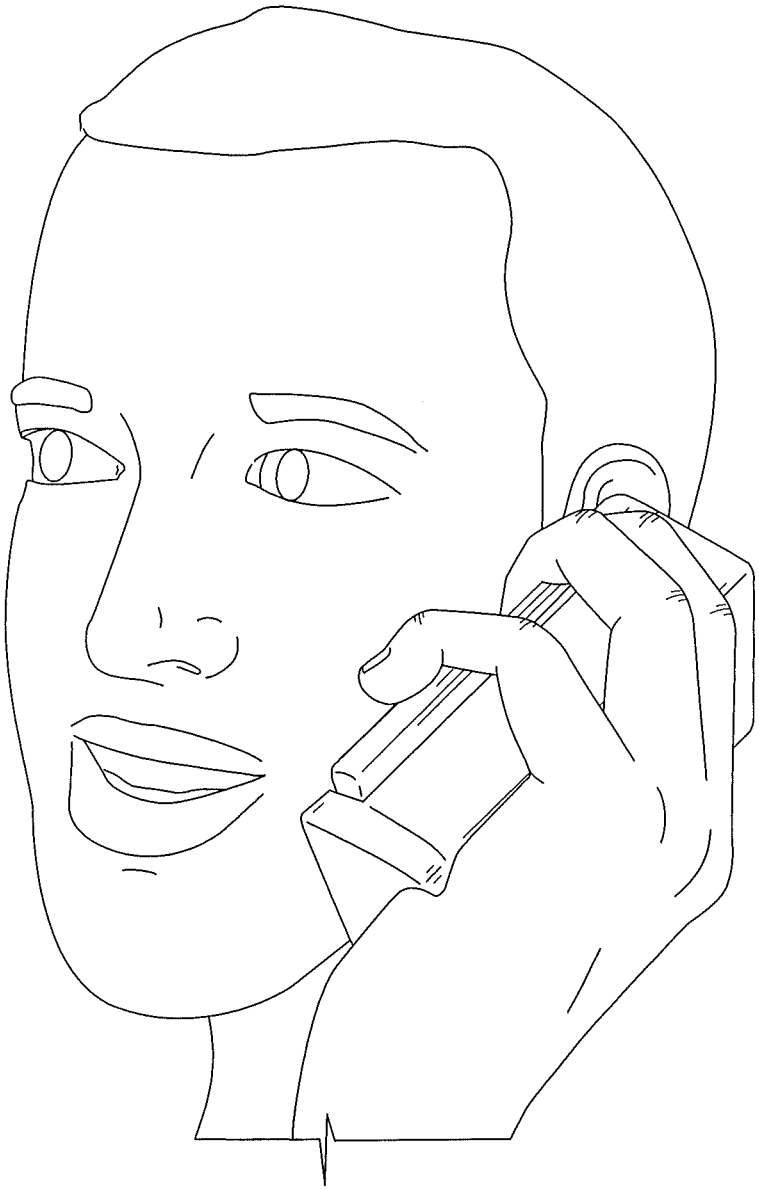
Figure 11:
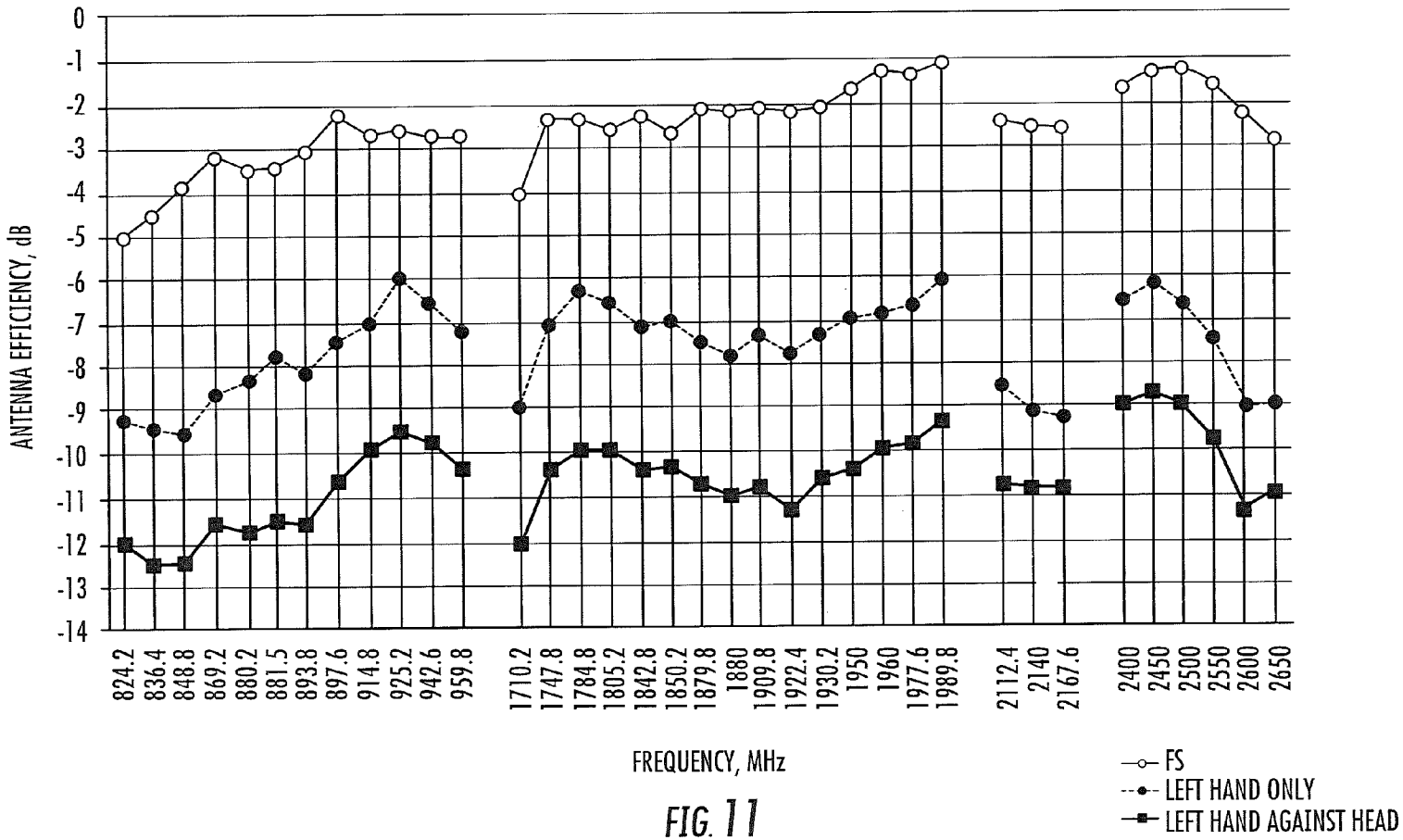
FIG. 11 is a graph illustrating measured performance of antennas in accordance with some embodiments of the present inventive concept in free space (FS) held by a phantom hand and in a talk position.

FIG. 11 is a graph illustrating efficiency (dB) vs. frequency (MHz) for the antenna systems in accordance with embodiments discussed herein for freespace (FS), handheld (FIG. 10A) and talk position against the head with the hand (FIG. 10B).

Figure 12:
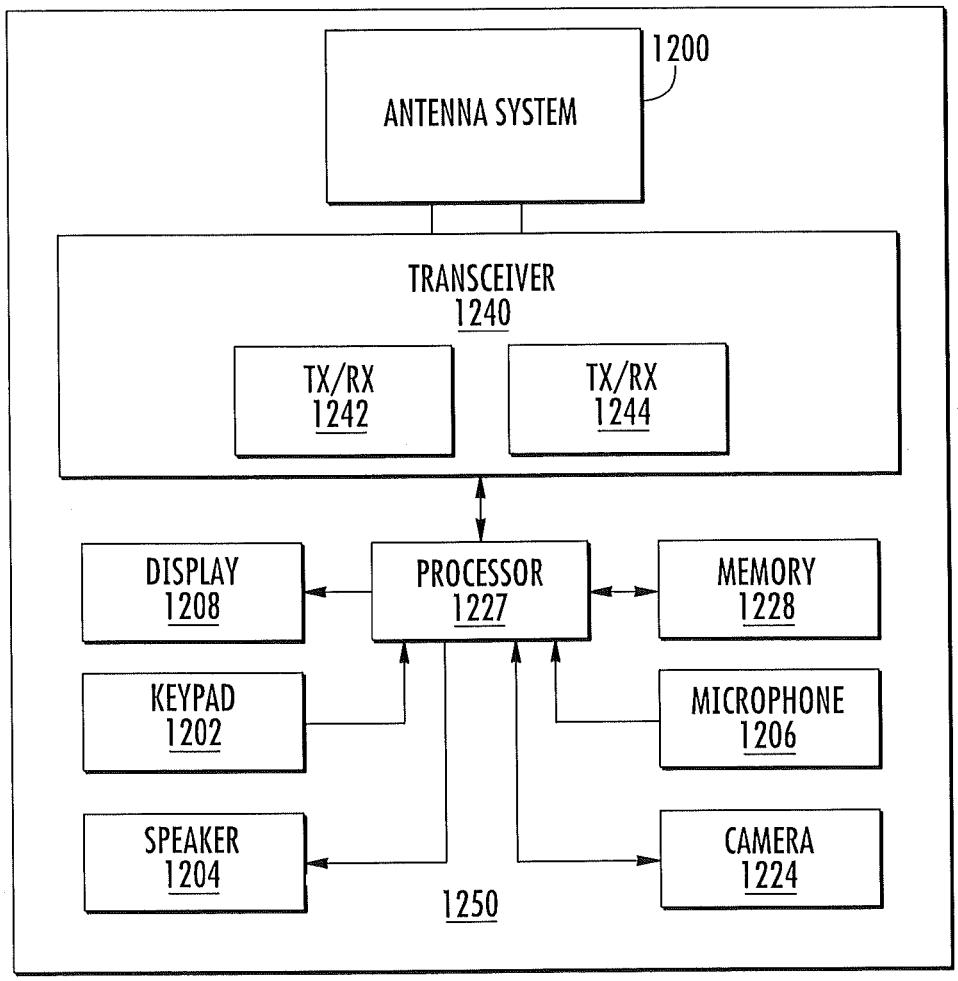
FIG. 12 is a block diagram of some electronic components, including an antenna system, of a wireless communication terminal in accordance with some embodiments of the present inventive concept.

Referring now to FIG. 12, a block diagram of a wireless communication terminal 1250 that includes an antenna system 1200 in accordance with some embodiments of the present inventive concept will be discussed. As illustrated in FIG. 12, the terminal 1250 includes an antenna system 1200, a transceiver 1240, a processor 1227, and can further include a conventional display 1208, keypad 1202, speaker 1204, mass memory 1228, microphone 1206, and/or camera 1224, one or more of which may be electrically grounded to the same ground plane (e.g., ground plane 405) as the antenna 1200. The antenna 1200 may be structurally configured as shown for the antenna systems of FIG. 4 or FIG. 7 or may be configured in accordance with various other embodiments of the present inventive concept.

The transceiver 1240 may include transmit/receive circuitry (TX/RX) that provides separate communication paths for supplying/receiving RF signals to different radiating elements of the antenna system 1200 via their respective RF feeds. Accordingly, when the antenna system 1200 includes two antenna elements, such as shown in FIG. 7, the transceiver 1240 may include two transmit/receive circuits 1242, 1244 connected to different ones of the antenna elements via the respective RF feeds.

The transceiver 1240 in operational cooperation with the processor 1227 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the inventive concept.

As discussed briefly above, antenna systems in accordance with some embodiments are capable of having good antenna performance in multiple frequency bands in a very low-profile fashion.

Antenna systems discussed herein generally have a profile (antenna height) lower than conventional grounded-type antennas while having similar or better antenna performance than that of a conventional grounded type antenna. These characteristics can be used in thin wireless communications devices.

Some embodiments discussed herein discuss a grounded-type antenna that can therefore be built over a ground plane. This characteristic may allows the antenna to be built without extending the overall length of the wireless communications device so that the antenna does not have any overlapping ground, i.e. ungrounded design such as a monopole antenna.

As discussed above, some embodiments of the antenna use a capacitive feeding method that energizes the two antenna elements located above the feed plate without any direct contact.

Embodiments of the present inventive concept may be suitable for use in wireless communications devices in its smallest size, often defined by the mobile device LCD display dimensions and battery thickness.

As discussed above, antenna systems in accordance with some embodiments may cover multiple frequency bands. The frequencies of coverage range from 800 MHz to 1000 MHz (Low-band range) and from 1700 MHz to beyond 2700 MHz (high-band range). In embodiments using the matching network of lumped components 406, the low-band frequency range can be controlled and tuned down to the 700 MHz bands to cover the LTE Band 13 and 17.

It will be appreciated that certain characteristics of the components of the antennas systems illustrated in the Figures such as, for example, the relative widths, conductive lengths, and/or shapes of the radiating elements, and/or other elements of the antennas may vary within the scope of the present inventive concept. Thus, many variations and modifications can be made to the embodiments without substantially departing from the principles of the present inventive concept. All such variations and modifications are intended to be included herein within the scope of the present inventive concept, as set forth in the following claims.

What is claimed is:

1. A low-profile antenna system, comprising:

a ground plane;

an upper antenna element parallel to and spaced apart from the ground plane, wherein a spacing between the ground plane and the upper antenna element is less than about 6.0 mm;

at least one vertical plate configured to vertically connect the upper antenna element and the ground plane;

first and second metallic wings each connected at one end to respective sides of the at least one vertical plate and spaced apart from both the ground plane and the upper antenna element;

an electrically floating plate on a same plane as the upper antenna element and spaced apart from the upper antenna element to provide a gap therebetween; and a metallic feed plate parallel to and between the upper antenna element and the ground plane and extending beneath the gap between the electrically floating plate and the upper antenna element.

2. The antenna system of Clam 1, further comprising a network of lumped components, wherein the lumped components are configured to control a low-band frequency range to tune the antenna system down to about 700 MHz to cover the long term evolution (LTE) bands without affecting the response in the high-band frequency range.

3. The antenna system of claim 1, wherein the ground plane has a width of about 60 mm and a length from about 110 mm to about 130 mm.

4. The antenna system of claim 1, further comprising a metallic frame configured to protect a display of a wireless communications device, wherein the metallic frame is the ground plane.

5. The antenna system of claim 1, further comprising a back cover of a wireless communications device, wherein the upper antenna element is positioned on an outer surface of the back cover of the wireless communications device.

6. The antenna system of claim 1, wherein the upper antenna element has a width of about 60 mm and a length from about 10 mm to about 25 mm.

7. The antenna system of claim 1, wherein the upper antenna element controls the high frequency band and wherein the high frequency band is from about 1700 MHz to beyond 2700 MHz.

8. The antenna system of claim 1, further comprising an antenna feed directly connected to the metallic feed plate.

9. The antenna system of claim 1:

wherein the metallic feed plate has one of an "L" shape and a rectangular shape; and wherein the gap between the upper antenna element and the electrically floating plate is from about 0.5mm to about 3.00 mm.

10. The antenna system of claim 1, wherein the metallic wings have a length that is less than a length of the upper antenna element.

11. The antenna system of claim 1, wherein the electrically floating plate has a width of about 60 mm and a length of about 45 mm.

12. The antenna system of claim 1, wherein the electrically floating plate is used to tune the high frequency band and wherein the high frequency band is from about 1700 MHz to beyond 2700 MHz.

13. The antenna system of claim 1, wherein the antenna system has wideband and multi-band resonance characteristics.

14. The antenna system of claim 13, wherein a low-frequency band range is from 800 MHz to about 1100 MHz and wherein a high-frequency range is from about 1700 MHz to beyond 2700 MHz.

15. A wireless communications device comprising:

a housing; and an antenna system coupled to the housing, the antenna system comprising:

a ground plane;

an upper antenna element parallel to and spaced apart from the ground plane, wherein a spacing between the ground plane and the upper antenna element is less than about 6.0 mm;

at least one vertical plate configured to vertically connect the upper antenna element and the ground plane;

first and second metallic wings each connected at one end to respective sides of the at least one vertical plate and spaced apart from both the ground plane and the upper antenna element;

an electrically floating plate on a same plane as, the upper antenna element and spaced apart from the upper antenna element to provide a gap therebetween; and a metallic feed plate parallel to and between the upper antenna element and the ground plane and extending beneath the gap between the electrically floating plate and the upper antenna element.

16. The device of claim 15, wherein the antenna system further comprises a network of lumped components, wherein the lumped components are used to control a low-band frequency range such that the antenna system can be controlled and tuned down to about 700 MHz to cover the long term evolution (LTE) bands.

17. The device of claim 15, wherein the housing further comprises a metallic frame configured to protect a display of a wireless communications device, wherein the metallic frame is the ground plane.

18. The device of claim 15, wherein the housing further comprises a back cover, wherein the upper antenna element is positioned on an outer surface of the back cover of the wireless communications device.

19. The device of claim 15, wherein the antenna system further comprises an antenna feed directly connected to the metallic feed plate.

20. The antenna system of claim 1, further comprising at least one vertical plate configured to vertically, directly connect the upper antenna element and the ground plane.

* * * * *